US005083964A

United States Patent [19]

Arad et al.

[11] Patent Number: 5,083,964

[45] Date of Patent: Jan. 28, 1992

[54] HOOP-LIKE TOY WITH COUNTER MECHANISM

[75] Inventors: Avi Arad, Westport, Conn.; Melvin R. Kennedy, New York, N.Y.

[73] Assignee: Tiger Electronics, Inc., Vernon Hills, Ill.

[21] Appl. No.: 585,690

[22] Filed: Sep. 19, 1990

[51] Int. Cl.[5] ..... A63H 1/00

[52] U.S. Cl. ..... 446/236; 446/28; 272/DIG. 5

[58] Field of Search ..... 446/236, 240, 242, 255, 446/28, 450; 272/128, DIG. 5

[56] References Cited

U.S. PATENT DOCUMENTS 989,944 4/1911 Bramson ..... 446/242 X
3,387,778 6/1968 Althaus .
3,729,860 5/1973 Kargul ..... 446/236
4,100,697 7/1978 Ward ..... 446/236 X
4,380,885 4/1983 Komagata ..... 446/236
4,480,831 11/1984 Muller-Deinhardt ..... 446/236 X
4,915,666 4/1990 Maleyko ..... 446/242

*Primary Examiner*—Danton D. DeMille
*Attorney, Agent, or Firm*—Dressler, Goldsmith, Shore, Sutker & Milnamow

[57] ABSTRACT

A hoop-like toy capable of automatically counting the number of rotations of the toy about a portion of a player. The hoop-like toy includes a torodially shaped member having a counter mechanism with an actuator displaceable upon contact with a player for indexing the counter mechanism and thereby counting rotations of the toy about a portion of the player.

15 Claims, 2 Drawing Sheets

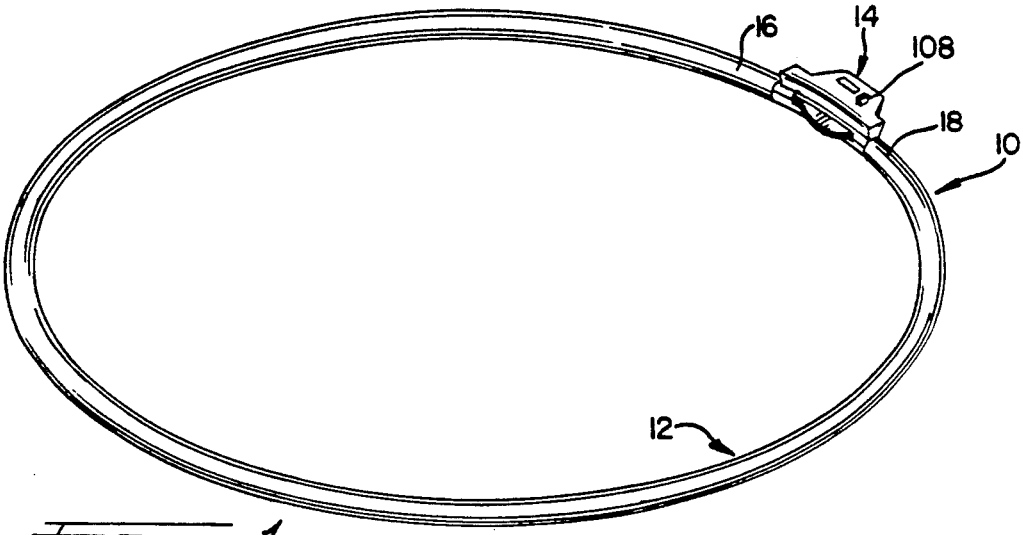
FIG. 1
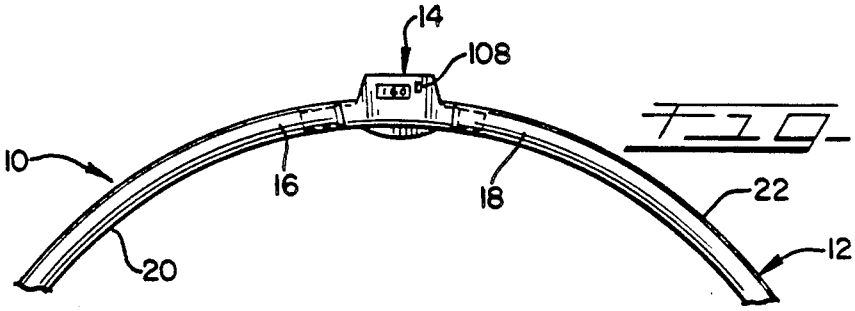
FIG. 2
FIG. 4
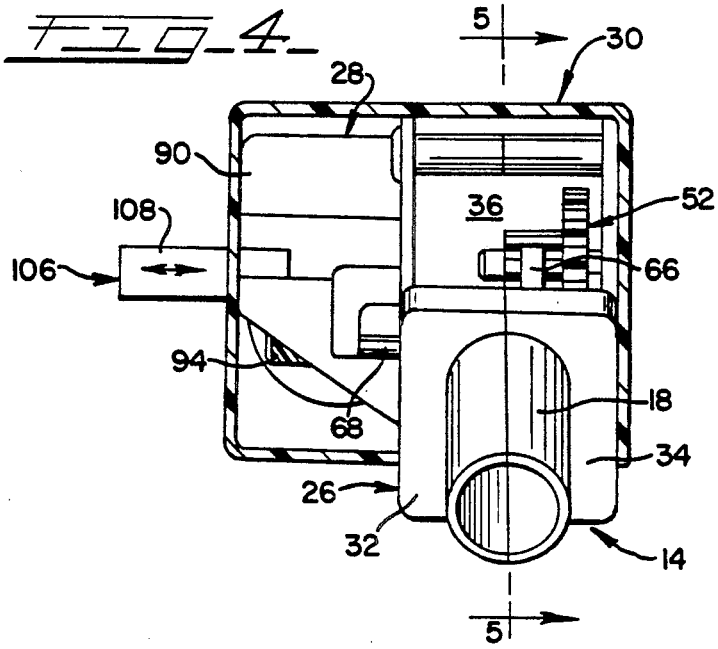

HOOP-LIKE TOY WITH COUNTER MECHANISM

FIELD OF THE INVENTION

The present invention relates to toys and, more particularly, to a hoop-like toy which is capable of monitoring the number of rotations of the toy about a portion of a player.

BACKGROUND OF THE INVENTION

Many recreational devices and toys combine recreation with physical benefit. A hoop-like toy which rotates about a player's waist is a good example of a toy which combines recreation with beneficial exercise. Such toys are commonly referred to as "Hula-Hoops."

A common usage involves placing the hoop-like toy about one's body and then manually imparting a spinning motion to the hoop. This motion is maintained by suitable body gyrations of the player. The physical benefits are greatest when the hoop is continually rotated about a player's waist area. As will be appreciated, the weight of the toy should be minimized such that the body motion of the player need not be too extensive to maintain rotation of the toy.

The gyrations a player must make to maintain the toy at the waist region stimulates the cardiovascular system, increases physical strength, and generally improves muscle tone and coordination. Of course, the physical benefits resulting from use of such a toy are proportional to the period of time one exerts such efforts.

In using such a toy, however, it is very easy to lose count of the number of rotations performed as a result of which, the user very quickly loses interest. The fun of playing with such a toy, therefore, could be increased if the number of rotations could be automatically calculated rather than requiring the player or another to maintain a constant visual and repetitive count.

SUMMARY OF THE INVENTION

In view of the above, and in accordance with the present invention, there is provided a hoop-like toy capable of automatically counting the number of rotations of the toy about a portion of the player. The hoop-like toy includes an annularly and preferably torodially shaped member with an automatic counter mechanism carried by the annularly shaped member. The counter mechanism includes a displaceable actuator for indexing the counter mechanism. As the annularly shaped member is rotated, the actuator is displaced by and engages with the player.

In a preferred form, the annular or torodially shaped member is configured to comfortably fit about a waist region of a player and has first and second end portions which are joined by an operative mechanism to form a closed hoop. In addition to joining or coupling the ends of the torodially shaped member, the operative mechanism includes the counter mechanism for automatically counting rotations of the hoop about a portion of the player.

To minimize cost and to facilitate manufacture of the toy, the torodially-shaped member is fabricated from an extruded plastic tube. The extrusion process provides at least the end portions of the torodially shaped member with hollow interiors. Moreover, the use of plastic provides both economy and strength for the toy.

A closed hoop having a predetermined circumference and defining inner and outer radially spaced surfaces is formed when the operative mechanism joins or couples the spaced apart ends of the torodially shaped member. To accomplish this end, the operative mechanism includes a housing which is at least partially configured to complement the torodially shaped member and is secured to the first and second end portions thereof. In a preferred form, the housing is of multipiece construction and defines attaching portions at opposite ends thereof. Such attaching portions are received, accommodated and attached within the hollow interior of the end portions of the torodial member. To promote rotation of the toy about a player, the housing has a curved inner surface with a radius generally corresponding to that defined by the inner surface of the hoop.

The actuator of the counter mechanism normally extends beyond the inner surface and toward the center of the hoop. In the preferred embodiment, the counter mechanism further includes a display for indicating the number of rotations of the hoop about the waist region of the player. In a most preferred form of the invention, the display is visible at generally a right angle to a plane defined by the annular member.

The present invention further includes a drive mechanism arranged within the housing of the operative mechanism for indexing the counter mechanism in response to a predetermined number of rotations of the toy about a portion of the player. In a preferred form, the drive mechanism includes a series of intermeshing gears having a drive ratio related to the predetermined circumference of the hoop. The gears are arranged in combination with the actuator for indexing the counter mechanism in response to displacement of the actuator. In a most preferred form of the invention, the actuator includes a rack portion which intermeshes with a pinion gear of the gear set. A resilient member, such as a spring, may be used for resiliently biasing the actuator toward the center of the hoop.

In the illustrated embodiment, the visual display of the counter mechanism includes a rotary unit dial, a rotary tens dial and a rotary hundreds dial coaxially mounted within the housing of the operative mechanism. A cover on the housing of the operative mechanism defines a window through which a portion of each dial is visible. The dials of the counter mechanism are indexed by the drive mechanism driven by the actuator. In a preferred form, the drive mechanism causes the unit dial on the visual display of the counter mechanism to index more than one unit each time the actuator is fully displaced in response to contact with the waist region of the player.

As will be appreciated, the torodially shaped member and the operative mechanism can each be inexpensively manufactured with relatively little weight. Accordingly, the tendency for the toy to gravitate downwardly is minimized. Moreover, the use of a gear set to positively index a counter mechanism allows rugged use of the toy without concern about electrical connections and a suitable power source as used in electrical counters. Notably, the ability to automatically count the rotation of the toy about a player adds enjoyment and a competitive nature to the toy.

Numerous other features and advantages of the present invention will become readily apparent from the following detailed description, the accompanying drawings, and the appended claims.

BRIEF DESCRIPTION OF THE DRAWINGS

FIG. 1 is a perspective view of a toy according to the present invention;

FIG. 2 is a partial plan view of the toy of the present invention;

FIG. 4 is a side sectional view taken along line 4—4 of FIG. 3;

DETAILED DESCRIPTION OF THE PREFERRED EMBODIMENT

Figure 3:
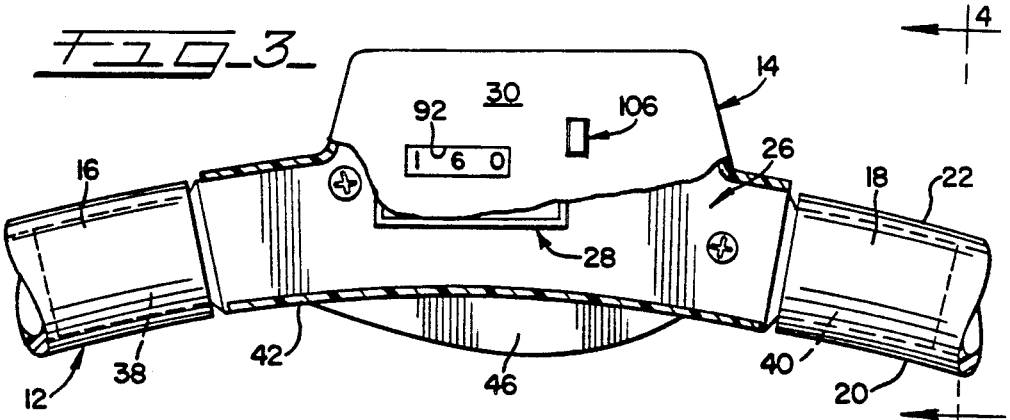
FIG. 3 is an enlarged plan view of a portion of the toy of the present invention.

While the present invention is susceptible of embodiment in various forms, there is shown in the drawings, and will hereinafter be described, a presently preferred embodiment with the understanding that the present disclosure is to be considered as an exemplification of the invention, and is not intended to limit the invention to the specific embodiment illustrated.

Referring now to the drawings, wherein like reference numerals indicate like parts throughout the several views, FIGS. 1 and 2 illustrate a hoop-like toy 10 including an annular or torodially shaped member 12 and an operative mechanism 14 for automatically counting the number of rotations of the toy about a portion of a player. The annular member 12 and the operative mechanism 14 combine to form a closed hoop having a predetermined circumference. As shown, the closed hoop is formed when the operative mechanism 14 is interposed between and joins or couples end portions 16 and 18 of member 12. The closed hoop defines inner and outer radially spaced surfaces 20 and 22, respectively.

The average person is not capable of sufficient body motion to impart sufficient velocity to a hoop of much less than 30 inches in diameter. Therefore, the preferred size of the closed hoop has an outside diameter which fits comfortably about a waist region of the player and ranges from between about 29 inches and about 40 inches. In a most preferred form, the outside diameter of the hoop measures about 30.750 inches.

The torodially shaped member 12 is preferably fabricated from a synthetic material such as plastic. Member 12 is preferably fabricated as an extruded plastic tube which provides hollow interiors at the end portions 16 and 18 thereof. The member 12 preferably has a weight ranging between about 7 ounces and about 10 ounces.

As seen in FIG. 3, the operative mechanism 14 is interposed between and joins or couples the spaced apart end portions 16 and 18 of member 12. The operative mechanism 14 includes a housing 26 which mounts a counter mechanism 28. In a preferred form, the operative mechanism 14 further includes a cover 30 which protects the counter mechanism 28 and provides a pleasing aesthetic appearance to the operative mechanism.

As illustrated in FIG. 4, the housing 26 has a generally curved configuration having a radius generally corresponding to that defined by the closed hoop. Housing 26 is preferably fabricated as a two-piece assembly including plastic pieces 32 and 34 which are secured to each other and which define a cavity 36 therebetween. The cover 30 surrounds or envelopes the cavity 36 and is releasably attached by any suitable means to the housing 26.

Returning to FIG. 3, laterally extending in substantially the same reference frame from opposite sides of the housing 26 are attaching portions 38 and 40. The attaching portions 38, 40 are configured to define, with housing 26, a circular arc substantially corresponding to the circular arc defined by the remainder of the closed hoop and which facilitates attachment of the spaced end portions 16 and 18 of member 12 to the operative mechanism 14. In the illustrated embodiment, each attaching portion 38, 40 defined by housing 26 has a generally circular cross-sectional configuration which is readily received and accommodated within the respective hollow interior end portions 16 and 18 of member 12. The attaching portions 38 and 40 may be coupled or fixed within the end portions 16 and 18 of member 12 by a suitable adhesive or staple-like fasteners thereby forming a closed hoop.

Intermediate the attaching portions 38 and 40, housing 26 is provided with a curved inner surface 42 having a radius generally corresponding to that defined by the inner surface 20 on member 12. By such construction, the inner surface 42 on housing 26 will be substantially contiguous with the inner surface 20 on member 12 thereby promoting the rotation of the toy about a portion of the player.

Figure 5:
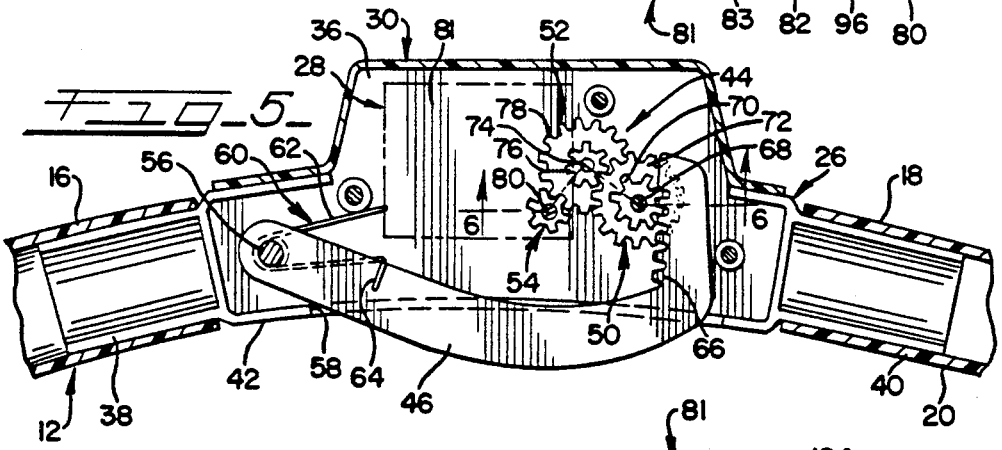
FIG. 5 is a sectional view taken along line 5—5 of FIG. 4.

Turning to FIG. 5, the counter mechanism 28 is mounted within the cavity 36 defined by housing 26 and is capable of visually displaying the number of rotations of the toy about a waist or other portion of the player. The display provided by the counter mechanism 28 is visible at generally a right angle to the plane defined by the closed hoop. The counter mechanism 28 is indexed by a drive mechanism 44 including an actuator 46.

Figure 6:
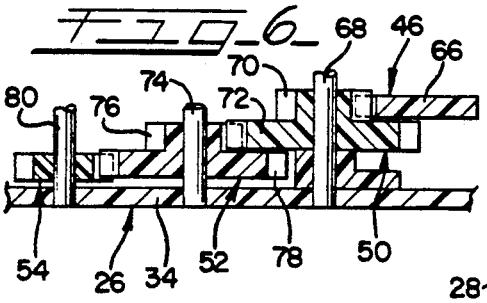
FIG. 6 is an enlarged sectional view taken along line 6—6 of FIG. 4.

FIGS. 5 and 6 schematically illustrate one form of a drive mechanism that can be used to automatically index a counter mechanism during play. To promote positive operation of the counter mechanism notwithstanding rugged use of the toy and without using wires, connectors and a power source typically required for electrical counters, the drive mechanism 44 preferably comprises a gear set fabricated from a lightweight synthetic material such as plastic. The gear set includes a series of intermeshing gears 50, 52 and 54 having a specific drive ratio related to the predetermined circumference of the closed hoop.

As illustrated in FIG. 5, the actuator 46 normally extends beyond the inner surface 20 and toward the center of the torodially shaped member 12. Upon rotation of the toy, the actuator 46 is displaceable upon contact with the player and drives mechanism 44 thereby indexing the counter mechanism 28 to count the number of rotations of the hoop about a portion of the player.

In the illustrated embodiment, the actuator 46 is radially displaceable and has a generally L-shaped planar configuration. One end of the actuator 46 is mounted within the cavity 36 of housing 26 for rotation about a pivot 56. Along surface 42, housing 26 is provided with an elongated slot 58 which allows for oscillatory movement of the actuator 46. A suitable resilient member 60, preferably in the form of a coil spring, is arranged in combination with the actuator 46. The coil spring has its center portion coiled about the pivot 56 with one free-ended arm 62 of the spring being confined against rotation in the first direction and another free-ended arm 64 acting to urge the actuator 46 toward the center of the closed hoop. An opposite end of the actuator 46 is provided with a rack gear portion 66. Notably, the rack gear portion 66 terminates short of the free end of the actuator 46.

Gear 50 of gear set 48 is designed as a combination gear which is mounted for rotation on a shaft 68. Opposite ends of shaft 68 are rotatably supported by the housing 26. The combination gear 50 includes a pinion gear portion 70 and a spur gear portion 72. As illustrated, pinion gear portion 70 is arranged in an intermeshing and driving relationship with the rack portion 66 of the actuator 46.

As will be appreciated, terminating the rack gear portion 66 on the actuator 46 short of its terminal end will act as a limit stop thereby inhibiting disengagement of the actuator 46 from the pinion gear portion 70 and also acts to position the actuator at a predetermined location extending inwardly toward the center of the hoop.

Gear 52 of gear set 48 is also designed as a combination gear which is mounted for rotation on a cantilevered shaft 74 supported by housing 26. The combination gear 52 includes a pinion gear portion 76 and a spur gear portion 78. As illustrated, the pinion gear portion 76 of gear 52 is arranged in intermeshing and driving relationship with the spur gear portion 72 of gear 50.

Gear 54 of gear set 48 is connected to a drive shaft 80 extending from counting mechanism 28. As illustrated, gear 54 is designed as a pinion gear which intermeshes with and is driven by spur gear 78 of combination gear 52.

Figure 7:
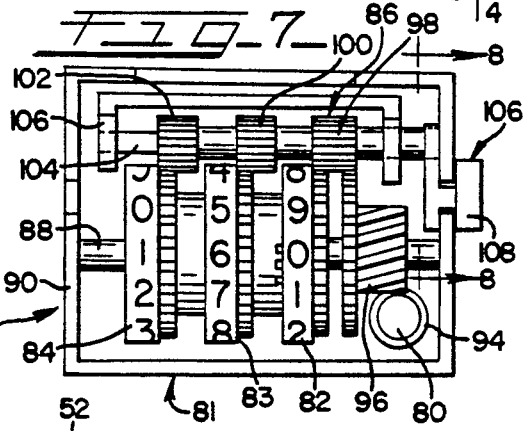
FIG. 7 is an enlarged plan view of a counter mechanism comprising part of the present invention.

Turning now to FIG. 7, counter mechanism 28 includes a counter 81 which is of conventional design for recording the number of revolutions of the toy about a portion of a player. As shown, the visual display of the counter 81 includes a series of counter wheels or dials 82, 83 and 84 which are indexed by a drive mechanism 86. In the illustrated embodiment, dial 82 is a rotary unit dial, dial 83 is a rotary tens dial, and dial 84 is a rotary hundreds dial. Each dial has the numbers 0–9 on the outside diameter at uniform distances. In the illustrated embodiment, the dials 82, 83 and 84 of counter 81 are coaxially mounted for indexed rotation on a shaft 88 supported by a housing 90. As illustrated in FIG. 3, the numbers or suitable indicia on each dial is clearly visible through a window 92 (FIG. 3) defined by cover 30.

The drive mechanism 86 for indexing counter 81 of the counter mechanism 28 includes the drive shaft 80 having gear 54 of drive mechanism 44 fixedly secured toward one end thereof. The opposite end of the drive shaft 80 is provided with a worm gear portion 94. The drive mechanism 86 further includes a combination gear 96 coaxially mounted with dials 82, 83 and 84 and secured to shaft 88. Gear 96 is arranged in driving engagement with worm gear portion 94. The combination gear 96 is also arranged in driving engagement with a series of driving gears 98, 100 and 102 which serve to conventionally index the dials 82, 83 and 84. The drive gears 98, 100 and 102 are coaxially mounted on a stub shaft 104 which is supported at opposite ends of a pivotably movable and spring biased mounting 106.

Figure 8:
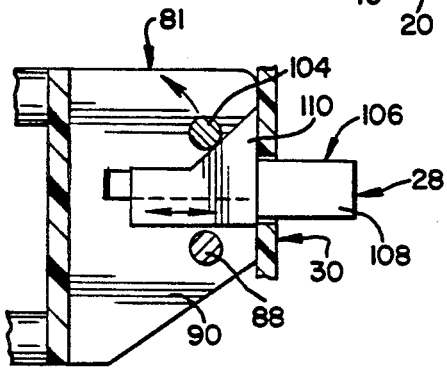
FIG. 8 is an enlarged side sectional view taken along line 8—8 of FIG. 7.

As illustrated in FIG. 8, the counter 81 of counter mechanism 28 may further include a reset mechanism 106 for allowing the counter 81 to be reset when desired by a player. In the illustrated embodiment, the reset mechanism 106 includes a linearly movable reset button 108 which extends beyond the cover 30 and which is linearly slidable on the housing 90 of the counter. As will be appreciated, the reset button 108 is spring biased such that it remains accessible to the player.

As shown in FIG. 8, the reset mechanism 106 includes a cam 110 which is responsive to movement of the reset button. Upon linear movement of the reset button 108, the cam 110 is adapted to engage the shaft 104 in a manner pivotably moving the drive gears 98, 100 and 102 (FIG. 7) out of engagement with and concurrently resetting each of the rotary dials to a 0 position.

The toy of the present invention is ready for use when the spaced apart end portions 16 and 18 of member 12 are joined by operative mechanism 14 to form a closed hoop. The toy of the present invention is used by placing it about a portion of the player. To yield the greatest physical benefit, the toy is arranged about the waist region or area of the player. A manual spinning motion is initially imparted to the toy. This motion is maintained by suitable body gyrations of the player thereafter. Moreover, the configuration of the inner surface 42 of the housing 26 on the operative mechanism 14, as it relates to the curvature of the inner surface 20 of the hoop, promotes continual rotation of the toy about the waist region of the player.

As will be appreciated, as the toy progressively rotates about the waist region of the player, the tangential contact between the user's waist and the toy circumferentially shifts along the inner surface of the closed hoop. The predetermined circumference of the toy is such that the toy makes about four complete revolutions about the waist of the player before there is a recurring tangential point of contact between the waist region and an identical point on the circumference of the inner surface of the closed hoop.

To compensate for variations of the point of contact, between the waist region of the player and the inner circumference of the hoop, the longer leg of the L-shaped actuator 46 extends generally tangential to the inner surface of the toy. As long as there is no contact therewith, the resilient member 60 urges the actuator beyond the inner surface and toward the center of the toy. As will be appreciated, and upon contact therewith during play, the actuator 46 will be displaced outwardly thereby indexing the counter mechanism 28.

Gear set 48 can be designed with a gear ratio such that upon full displacement of the actuator 46, the visual display of the counter mechanism 28 is progressively indexed by four units. As will be appreciated, a player's dexterity can be measured by the number of continuous rotations of the toy about the waist region of the player.

To enhance play, the counter mechanism 28 automatically maintains score of the number of rotations of the toy. By fabricating the majority of the parts comprising the toy from synthetic lightweight material, such as plastic, the weight of the toy is minimized without detracting from its ability to withstand rugged use. Moreover, the preferred use of a gear set, as a drive mechanism for positively indexing the counter mechanism, will eliminate the need for a power source, wires and electrical connections normally typically used in electrical counters. Upon completion, the player may reset the counter mechanism 28 through actuation of the reset mechanism 106.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A toy comprising:

an annularly shaped member configured to comfortably fit about a waist region of a player; and counting means carried by said member for counting the number of rotations of said member about the waist of the player, said counting means including a counter mechanism and reciprocally movable actuator means responsive to forces directed outwardly from the center of said member for indexing the counter mechanism, at least a portion of said actuator means extending inwardly from an inner peripheral edge of said member and exposing said actuator to react a direct engagement with the player and move outwardly away from the center of said member as the member is rhythmically rotated about the player.

2. The toy according to claim 1 wherein said counter mechanism includes means visible at generally a right angle to a plane defined by said member for indicating the number of rotations of the toy about the player.

3. The toy according to claim 1 wherein the exposed portion of said actuator means is defined by a lever which is displaceable upon contact with a player.

4. A toy comprising:

an annularly shaped member with first and second end portions; and operative means for joining said first and second end portions of said annularly shaped member to form a closed hoop having a generally hollow interior annulus, said operative means including counting means for counting the number of rotations of the hoop about a portion of a player, said counting means extending within and along a region of said interior annulus and comprising drive means including an actuator movable in response to forces directed outwardly from the center of said member for indexing said counting means, with at least a portion of said actuator extending inwardly past an inner periphery of said member to react to direct engagement with the player and move outwardly away from the center of said member as the member is rotated about the player.

5. The toy according to claim 4 wherein said counting means includes means for visually displaying the number of rotations of the hoop about a portion of the player.

6. The toy according to claim 4 wherein said operative means includes a housing which is at least partially configured to complement said annularly shaped member and be secured to said first and second end portions thereof.

7. The toy according to claim 6 wherein said drive means includes a gear set arranged within said housing and driven by said actuator for indexing said counting means in response to a predetermined number of rotations of the hoop about a portion of a player.

8. A toy adapted to be rotatably swung in a generally horizontal path about a waist region of a player, said toy comprising:

a torodially shaped member having first and second end portions and a generally hollow interior, wherein said end portions are spaced apart from each other; and operative means for joining said first and second end portions of said torodially shaped member to form a closed hoop having a predetermined circumference and defining inner and outer radially spaced surfaces, said operative means having a generally hollow interior and a counter mechanism arranged within the hollow interior for counting the number of rotations of the hoop about the waist region of the player and an actuator mounted for rotation about an axis extending normal to the plane of said closed hoop and in response to forces directed outwardly from the center of said member, at least a portion of said actuator normally extending beyond the inner surface and toward the center of said hoop to react to engagement with the player and rotatably move away from the center of the hoop to index the counter mechanism through a predetermined number of progressive counts upon displacement thereof.

9. The toy according to claim 8 wherein said operative means further includes a housing for mounting said counter mechanism, said housing having a curved configuration with a radius generally corresponding to that defined by said hoop.

10. The toy according to claim 10 wherein at least the end portions of said torodially shaped member have hollow interiors for receiving and accommodating attaching portions of said housing therewithin.

11. The toy according to claim 8 wherein said counter mechanism includes means for visually displaying the number of rotations of the toy about the waist region of the player.

12. The toy according to claim 11 wherein said visual display means includes a rotary unit dial and a rotary tens dial coaxially mounted within a housing having a cover defining a window through which a portion of each dial is visible.

13. The toy according to claim 12 wherein said counter mechanism further includes a series of intermeshing gears having a drive ratio related to the predetermined circumference of said hoop, said gears being arranged in combination with said actuator to cause said unit dial on said visual display means to index more than one unit each time said actuator is fully displaced.

14. The toy according to claim 13 wherein said actuator includes a rack portion which intermeshes with one of said series of gears.

15. The toy according to claim 8 wherein said operative means further includes spring means for resiliently biasing said actuator toward the center of said hoop.

* * * * *